United States Patent [19]

Bell et al.

[11] 4,229,043

[45] Oct. 21, 1980

[54] COWL ARRANGEMENTS FOR MINING MACHINES

[75] Inventors: Roy L. Bell, Burton-on-Trent; James B. Garner, Mansfield; Douglas Salmon, Newark, all of England

[73] Assignee: Coal Industry (Patents) Limited, London, England

[21] Appl. No.: 954,155

[22] Filed: Oct. 24, 1978

[51] Int. Cl.[2] ..... E21D 19/02

[52] U.S. Cl. ..... 299/33; 299/11; 299/45; 405/288

[58] Field of Search ..... 299/11, 31, 33, 45; 61/288

[56] References Cited

U.S. PATENT DOCUMENTS

| | | | |
|---|---|---|---|
| 3,291,533 | 12/1966 | Rae | 299/45 |
| 3,397,927 | 9/1968 | Groetschel | 299/11 |
| 4,068,894 | 1/1978 | Dring | 299/45 |
| 4,099,785 | 7/1978 | Groetschel | 299/11 |
| 4,122,682 | 10/1978 | Groetschel | 405/294 X |

FOREIGN PATENT DOCUMENTS

| | | | |
|---|---|---|---|
| 2655511 | 6/1978 | Fed. Rep. of Germany | 299/11 |

*Primary Examiner*—William F. Pate, III

*Attorney, Agent, or Firm*—James Creighton Wray

[57] ABSTRACT

A roll of wire mesh is supported on the rear of a cut mineral loading cowl of a rock or mineral winning machine. As the machine traverses along a path cut by the machine the wire mesh is paid out to retain or contain the roof material.

6 Claims, 6 Drawing Figures

COWL ARRANGEMENTS FOR MINING MACHINES

Figure 1:
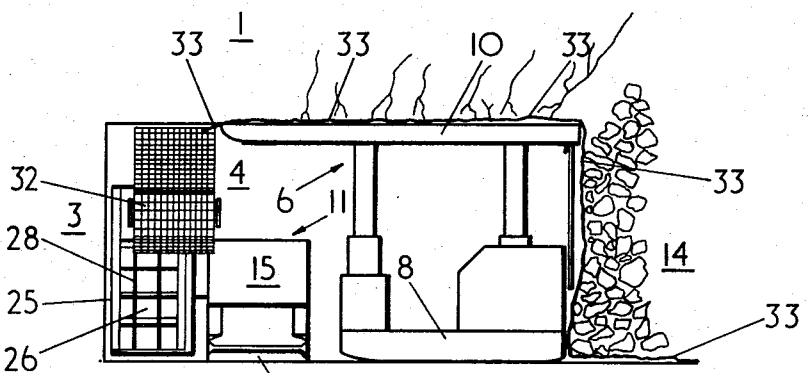

The description in the patent application of Eric Dring, Ser. No. 953,248, filed Oct. 20, 1978, for Equipment for Laying Elongate Material is related to this application in that both applications refer to means for dispensing elongate material. The claims of this invention are of a full, concise, and exact nature so as not to conflict with the claims of the aforesaid application.

This invention relates to cut mineral loading arrangements for mining machines. In an underground coal mine, a mining machine including a cutter head traverses winning coal from an adjacent coal face. The mining machine is supported on an armoured face conveyor, which is advanced towards the coal face in a well known snake-like manner after passage of the mining machine.

The mine roof formed behind the mining machine, i.e. where coal has been extracted by the cutter head as the machine traverses along its path, is subsequently supported by plurality of mine roof supports.

If the mine roof is of a friable nature it tends to break and fall between the roof supports. Such breaking and falling constitutes a danger to men and machinery on the coal face.

To mitigate this problem, it has been proposed to contain friable roof material adjacent to the mine roof by laying containing material such as wire mesh thereagainst, the containing material being positioned in secutive layers arranged side-by-side. In the past such layers have been laid manually, but such a procedure is dangeous and time consuming.

In some installations wherein wire mesh is used for the supporting of mine roof by containing such friable material, the wire mesh has to pass over an operating cutter drum. Such passage is disadvantageous because the mesh can foul the cutting unit.

An object of the present invention is to provide an arrangement for a mining machine which tends to overcome the above mentioned disadvantages.

Accordingly, the present invention provides a cut mineral loading arrangement for a mining machine which includes a cutter head and which in use traverses along a path cut by the machine, comprising a cut mineral loading member mountable adjacent to the rear of the cutter head which in association with said loading member urges cut mineral towards conveyor means, and means securable to said loading member for paying out an elongated element extending along the cut path, the elongated element being arrangeable to retain or contain mine roof material.

The means comprises a bracket securable to the loading member. The bracket is at least in partly pivotally securable to the loading member. The loading member has ribs on its rearmost face and the bracket engages the ribs.

Preferably, the bracket comprises a first part securable to the loading member and a second part slidably engagable with the first part.

Conveniently, the means comprises a spindle detachably securable to the bracket. The elongated element for retaining or containing the roof material is supported on the spindle. The elongated element conveniently comprises a wire mesh rool with the spindle positioned along the axis of the roll.

Figure 2:
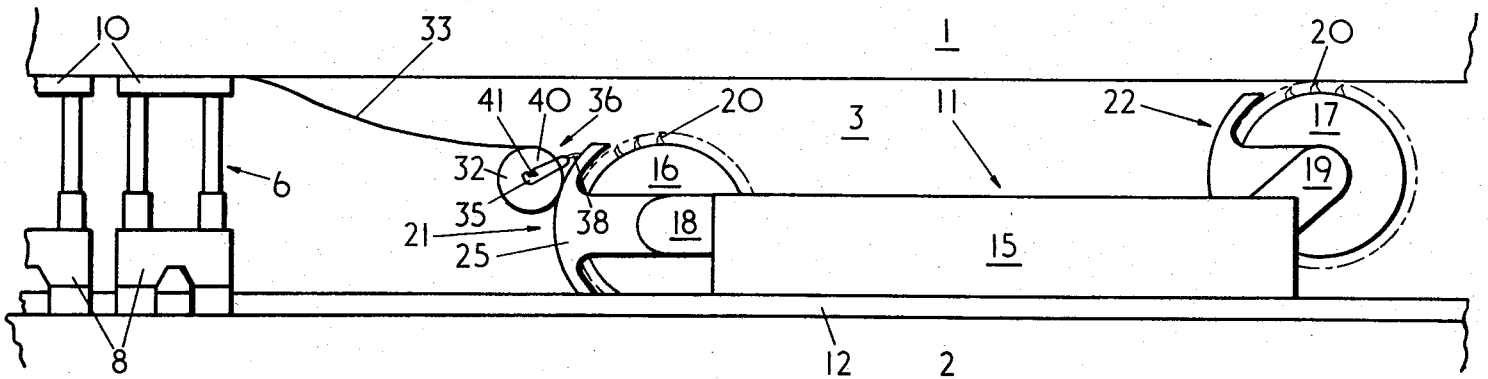
Figure 3:
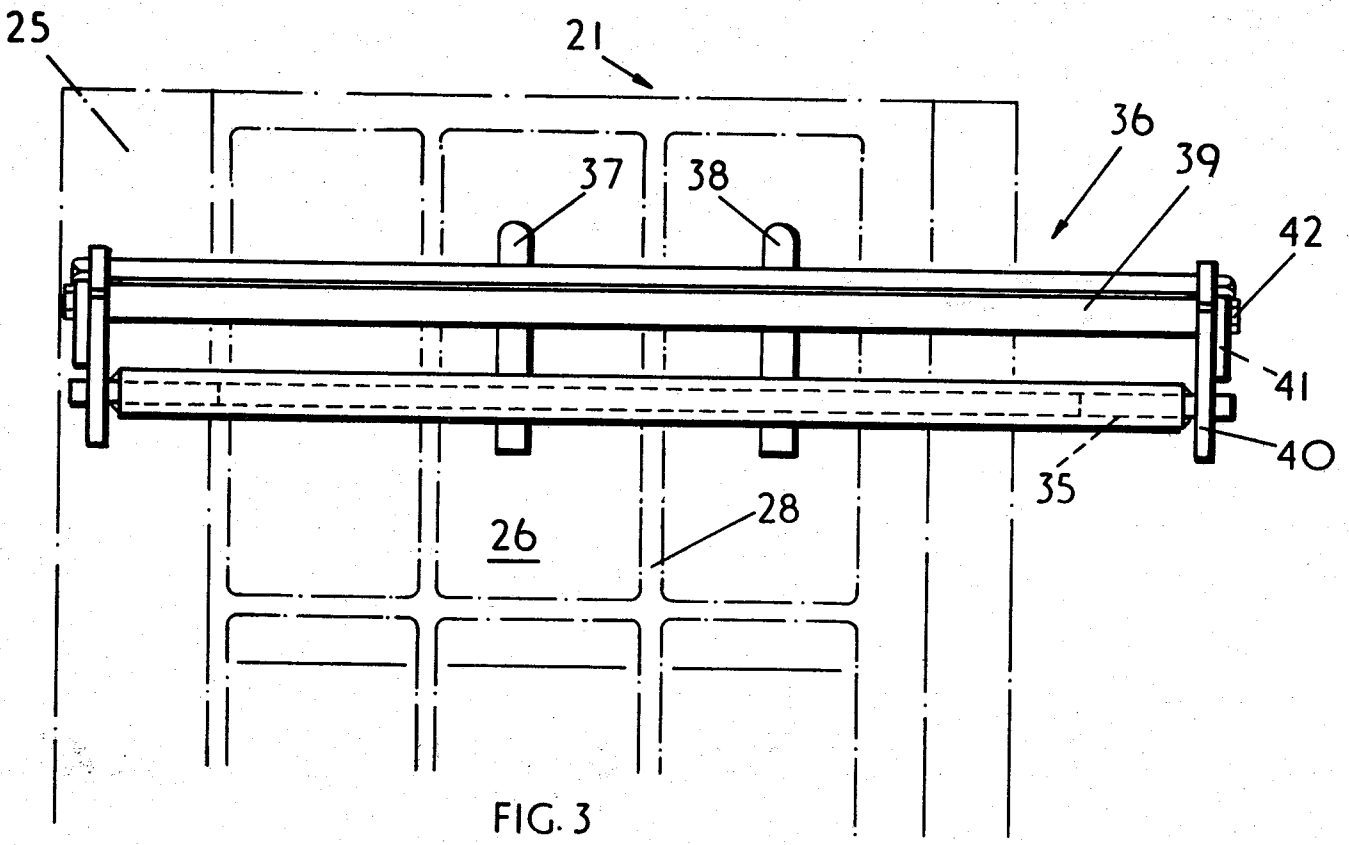
Figure 4:
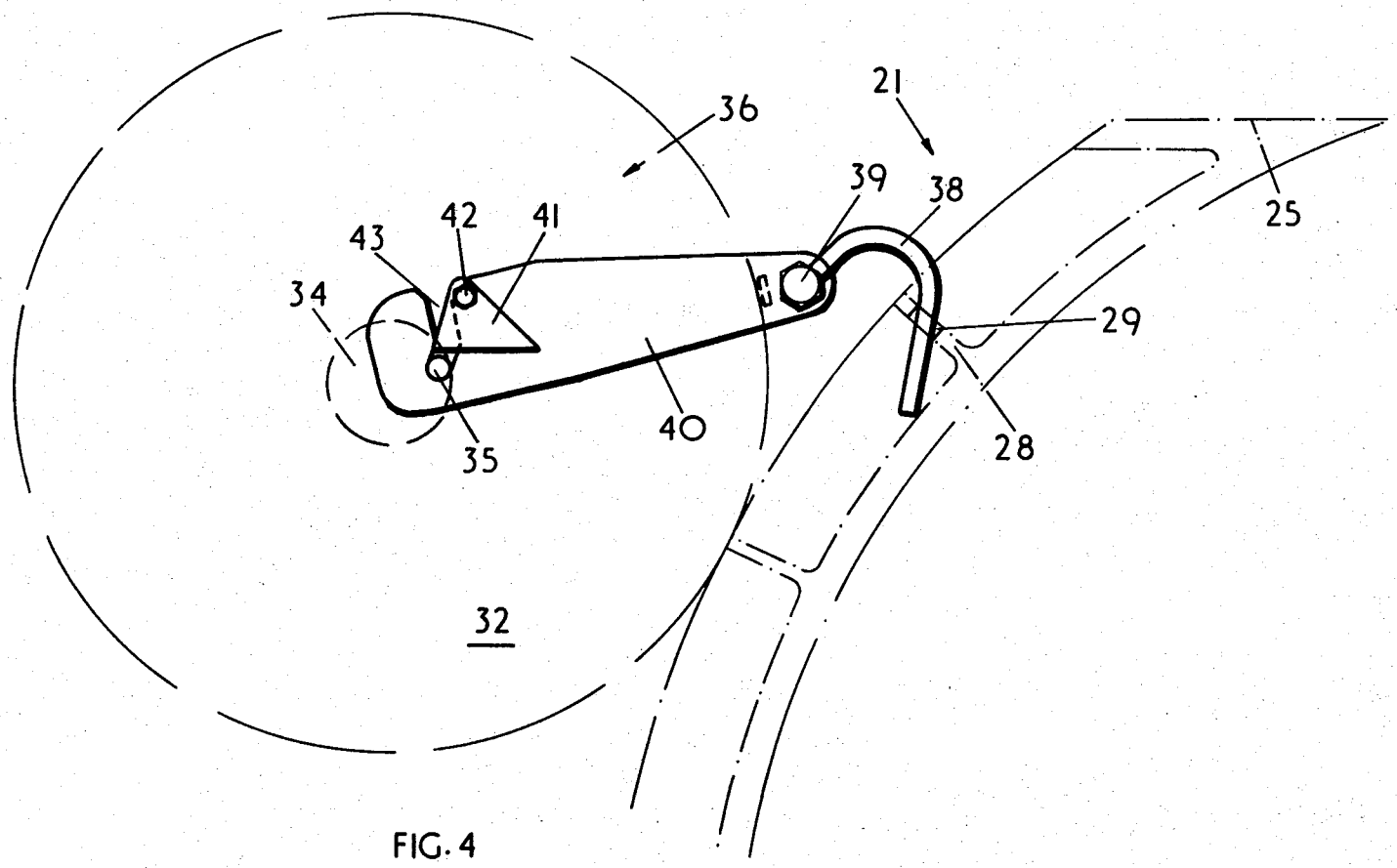
Figure 5:
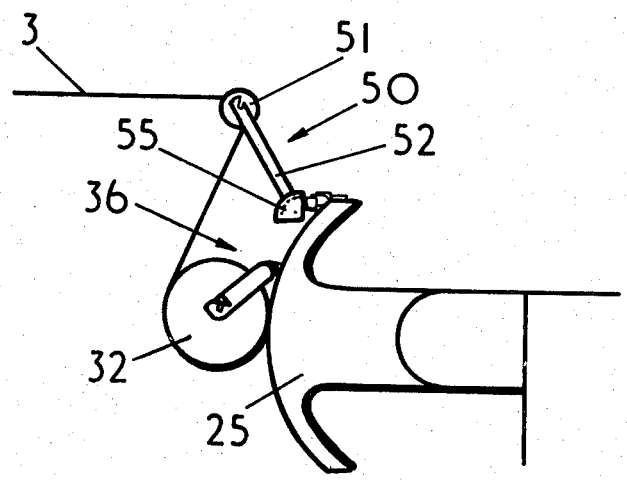
Figure 6:
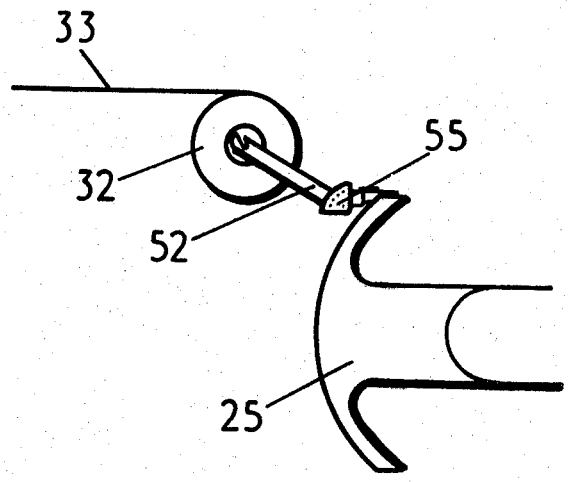

Three embodiments of the present invention will now be described, by way of example only, with reference to the accompanying drawings in which:

FIG. 1 is an incomplete diagrammatic view of a mining installation looking along a coal face, FIG. 2 is a diagrammatic view of part of a mining installation, looking towards to coal face, FIG. 3 is an enlarged view of part of FIG. 1, FIG. 4 is an enlarged view of part of FIG. 2, FIG. 5 is a view of part of FIG. 2 showing a second embodiment of the invention, and FIG. 6 is a similar view to FIG. 5, but of a third embodiment of the invention.

Referring to FIGS. 1 and and 2 a mining installation can be seen to comprise a mine roof 1 and a mine floor 2. A coal seam is generally indicated at 3 and a coal face area at 4. The mine roof 1 in the coal face area is supported by mine roof supports 6, two of which are shown and which comprise base parts 8 and canopies 10. Loose friable mine roof tending to fall in and around the coal face area 4 is contained by wire mesh sheets 33, which sheets are described in more detail below.

A mining machine 11 traverses along a path 4 cut by the machine winning coal from the seam 3 and the roof supports 6 are advanced towards the newly exposed coal face after passage of the machine. The machine 11 traverses to and fro along the coal face upon an armoured face conveyor 12. The armoured face conveyor 12 is advanced towards the coal face in a known snake-like manner by rams (not shown) between the roof supports and conveyor 12 after the machine 11 has passed. Mine roof behind the roof supports 6 and away from the coal face is allowed to collapse into a goaf 14.

The mining machine 11 includes a body 15 and two cutter heads comprising rotary drums 16 and 17. The cutter drums 16 and 17 are rotatably mounted on arms 18, 19 respectively and the arms are pivotally connected to opposite ends of the body 15. The cutter drums are provided with coal cutting picks, some of which are shown at 20. The coal cutter drums 16, 17 are provided with cut mineral loading arrangements constituted by cowl arrangements 21 and 22, respectively, which in association with the rotating cutter drums urge cut material towards the conveyor 12. The coal arrangement 21 is now described in more detail with reference to FIGS. 1, 2, 3 and 4.

The cowl arrangement 21 comprises a cowl 25 which on the machine traverses along the coal face is located adjacent to the rear of the cutter drum 16. However, the coal 25 is rotatably mounted about the end of the arm 18 away from the machine body 15 so that upon the machine reaching the end of a traverse along the working face it can be swung to the other side of the cutter drum which when the machine changes its direction of traverse now becomes the rear side. The cowl 25 has a rear most surface or outer periphery 26 provided with rib 28 shown in FIGS. 1 and 3. One of the ribs 28 contains bores 29.

Means 36 including a roll 32 of wire mesh material, for containing loose friable mine roof to prevent spillage into the coal face area is supported on the cowl 25 by virtue of the bores 29. The roll 32 of mesh contains a hollow passage 34 along the principal axis thereof. A spindle 35 is insertable within the hollow passage 34 and the spindle is detachably engagable in a bracket assembly (38, 40). The bracket assembly (38,40) has hooks 37 and 38 bolted to a component 39 thereof and these hooks slidably engage the bores 29.

In addition to the component 39, the bracket assembly comprises a generally 'U' shaped component or part 40 having two limbs as can be seen in FIG. 3 for supporting opposite ends of the spindle 35. The part 40 is slidably engaged on the component 39 and the part can be slid towards or away from the coal face while the component 40 and the cowl 25 remain fixed in position with respect to the face. This sliding is useful in operation described below.

The spindle 35 is detachable secured to limbs of the part 40 of the bracket assembly by means of generally triangular plates 41 and guides 43 in the said links. Only one plate 41 and guide 42 is shown in FIG. 4. The plates 41 pivot about bolts 42 and are pushed away and rotate counter clockwise when the spindle 35 is inserted and fall back clockwise under gravity when the spindle 35 is in position. The spindle cannot be pulled out of the guides 43 because such pulling urges the plate clock wise and causes it to jam. However an operator can rotate the plate 4 counter clockwise to allow removal of the spindle.

In operation of the invention, the mining machine traverses to and fro along its cut path winning coal, the leading drum cutting the roof, and the trailing drum the floor. The means 36 is attached to the cowl of the trailing cutter drum. In FIG. 2, the mining machine 11 is traversing from left to right so that the drum 16 is trailing. Consequently the means 36 constitutes part of the coal arrangement 21. When the machine 11 traverses from right to left, then the drum 17 would trail and the bracket 36 would be made part of the cowl arrangement 22.

The hooks 37 and 36 are readily insertable and removable from the bores 29 and similar bores in the cowl arrangement 22, so the means 36 can be changed between the cowl arrangements 21, 22 when the machine 11 changes direction.

As the machine 11 moves, wire mesh 33 is unwound or paid out from the role 32 of wire mesh and the mesh is pulled towards the mine roof as shown in FIGS. 1 and 2. The wire mesh is pinned to the roof by the roof supports 6 as the latter are positioned after each consecutive advance towards the newly exposed coal face. The wire mesh 33 is secured to previously positioned layer of wire mesh to secure it in position before the roof supports are positioned to underpin the wire mesh.

As has been disclosed the bracket part 40 is movable towards and away from the coal face with respect to the cowl 25 and this movement is utilised to ensure that the wire mesh currently being unwound or paid out is positioned suitably for attachment to already positioned mesh.

During operation should the roll of mesh 33 be used up a new roll is placed on the spindle 35 to ensure continued effective containment is maintained. This operation is facilitated by the triangular plate 41 and guide 42 attached to the limbs of the part 40 of the bracket 36 as described previously.

The consectutive layers of positioned wire mesh is variously shown at 33 in FIG. 1. It can be seen that the mesh is forced down into the goaf 14 after being passed by the roof support 6. Consequently the wire mesh retains or contains friable roof in the whole vicinity of the coal face and mine roof supports.

A second embodiment of the invention is now described with reference to FIG. 5 which shows an alternative form of cowl arrangement. The same reference numerals are used in FIG. 5 where appropriate. A roller of sliding shoe arrangement 50 is attached to the cowl 25. The roller or sliding shoe arrangement comprises a roller or shoe 51 mounted on a shaft 52. The shaft 52 is pivotally mounted in a bracket 53 which is slidably secured to the cowl and can be moved towards or away from the coal face independently of the cowl 25. The shaft 51 can be pinned in any of a plurality of angular positions with respect to the cowl 25. In this way the roller or shoe is urged to the roof and the apparatus is adaptable to urge mesh to roof in a variety of seam heights.

The shaft 52 is conveniently made of resilient material such as spring steel so that the roller is urged to the mine roof even when passing over undulations therein.

A third embodiment of the invention is now described with reference to FIG. 6. The same reference numerals are used in respect of the third embodiment as in respect of the first two described embodiments where appropriate. In the third embodiment, it may be seen that the roll of mesh 33 is itself urged towards the mine roof by the shaft 52. In this way the mesh is held against the roof so that the unwound mesh does not foul roof supports before they can be positioned thereunder.

From the above description it may be seen that the present invention provides an improved cowl arrangement for a mining machine.

We claim:

1. A cut mineral loading arrangement for a mining machine which includes a cutter head and which in use traverses along a path cut by the machine, comprising a cut mineral loading member mountable adjacent to the rear of the cutter head which in association with said loading member urges cut mineral towards conveyor means, and a bracket which is at least partly pivotally supported with respect to said loading member for paying out an elongated element extending along the cut path, the elongated element being arrangeable to retain or contain mine roof material.

2. An arrangement as claimed in claim 1, in which the loading member has ribs on its remote face and the bracket engages the ribs.

3. An arrangement as claimed in claim 1, in which the bracket comprises a first part securable to the loading member and a second part slidably engagable with the first part.

4. An arrangement as claimed in claim 1, in which the means comprises a spindle detachably securable to the bracket.

5. An arrangement as claimed in claim 4 in which the elongated element for rataining or containing the roof material is supported on the spindle.

6. An arrangement as claimed in claim 5, in which the elongated element comprises a wire mesh roll with the spindle positioned along the axis of the roll.

* * * * *